US006127985A

United States Patent [19]

Guler

[11] Patent Number: 6,127,985

[45] **Date of Patent: *Oct. 3, 2000**

[54] DUAL POLARIZED SLOTTED ARRAY ANTENNA

[75] Inventor: Michael G. Guler, Dawsonville, Ga.

[73] Assignee: EMS Technologies, Inc., Norcross, Ga.

[ * ] Notice: This patent is subject to a terminal disclaimer.

[21] Appl. No.: 09/259,777

[22] Filed: Mar. 1, 1999

Related U.S. Application Data

[63] Continuation-in-part of application No. 08/903,678, Jul. 31, 1997, Pat. No. 6,028,562.

[51] Int. Cl.[7] ..... H01Q 13/10

[52] U.S. Cl. ..... 343/771; 343/770

[58] Field of Search ..... 343/770, 771, 343/767, 772, 776, 789; H01Q 13/10

[56] References Cited

U.S. PATENT DOCUMENTS

| | | | |
|---|---|---|---|
| 3,503,073 | 3/1970 | Ajioka | 343/771 |
| 3,990,079 | 11/1976 | Epis | 343/771 |
| 4,673,946 | 6/1987 | Hoover | 343/776 |
| 4,792,809 | 12/1988 | Gilbert et al. | 343/770 |
| 4,985,708 | 1/1991 | Kelly | 343/771 |
| 5,030,965 | 7/1991 | Park et al. | 343/770 |
| 5,406,292 | 4/1995 | Schnetzer et al. | 343/700 MS |
| 5,473,334 | 12/1995 | Yee et al. | 343/756 |
| 5,543,810 | 8/1996 | Park | 343/771 |
| 5,581,266 | 12/1996 | Peng et al. | 343/770 |
| 5,596,336 | 1/1997 | Liu | 343/771 |
| 5,619,216 | 4/1997 | Park | 343/771 |
| 5,661,493 | 8/1997 | Uher et al. | 343/700 MS |
| 6,028,562 | 2/2000 | Guler et al. | 343/771 |

FOREIGN PATENT DOCUMENTS

WO97/22159 6/1997 WIPO .

OTHER PUBLICATIONS

"Arbitrarily Polarized Slot Radiators in Bifurcated Waveguide Arrays", by James S. Ajioka, Dick M. Joe, Raymond Tang, and Nam San Wong, IEEE Transactions of Antennas and Propagation, vol. AP–22, No. 2, Mar., 1974, pp. 196–200.

(List continued on next page.)

*Primary Examiner*—Hoanganh Le
*Attorney, Agent, or Firm*—King & Spalding

[57] ABSTRACT

A waveguide-implemented antenna comprising a planar array of waveguide slot radiators for communicating electromagnetic signals exhibiting simultaneous dual polarization states. The antenna can consist of parallel ridged waveguides having rectangular or "T"-shaped ridged cross sections. The ridged walls of each parallel ridged waveguide contain a linear array of input slots for receiving (transmitting) electromagnetic signals having a first polarization state from (to) the parallel ridged waveguides and for transmitting (receiving) those signals into (from) a corresponding array of cavity sections. The cavity sections comprise a short section of uniform waveguide with a thickness of much less than a wavelength in the propagation direction. The cavity sections feed to output slots which are rotated relative to the input slots; such that the output slots exhibit a second polarization state, which they radiate (receive) to (from) free space. By interlacing parallel ridged waveguides with alternating +45 degree and −45 degree rotations of the output slots, two independent antennas are formed exhibiting simultaneous dual polarizations. Because the input slots are located in the ridge wall of the parallel ridged waveguides, the parallel ridged waveguides can be fed from their broad wall side. Feeding the parallel ridged waveguides from their broad wall side eliminates a need for a complex feed network.

33 Claims, 14 Drawing Sheets

OTHER PUBLICATIONS

"Dual Polarised Slotted Waveguide SAR Antenna", by Lars Josefsson and C.G.M. van't Klooster, IEEE Antennas and Propagation Society International Symposium, vol. 1, Jul. 18–25, 1992, pp. 625–628.

"Polarisation Diversity Techniques for Slotted–Waveguide Array Antennas", by A.J. Sangster, Mikrowellen & HF Magazine, vol. 15, No. 3, 1980, pp. 237–243.

"A Dual Polarised Slotted Waveguide Array Antenna", by L. Josefsson, Proceedings of the 1992 URSI International Symposium on Electromagnetic Theory, Aug. 17–20, 1992.

"Concept of an X–Band Synthetic Aperture Radar for Earth Observing Satellities", by W. Jatsch and E. Langer, Journal of Electromagnetic Waves and Applications, vol. 4, No. 4, 1990, pp. 325–340.

"Slot Array Antenna System for COMETS", by Yoshihiro Hase, Noriaki Obara, Haruo Saitoh, and Chiharu Ohuchi, 1996 IEEE 46th Vehicular Technology Conference, May 1996, pp. 353–356.

"A Two–Beam Slotted Leaky Waveguide Array for Mobile Reception of Dual Polarization DBS", by J. Hirokawa et al., IEEE Antennas and Propagation Society International Symposium, vol. 1, Jul. 21–26, 1996, pp. 74–77.

"Dual Polarized Slotted Array Antenna" patent application Serial No. 08/903,678 filed Mar. 1, 1999; Attorney Docket No. 05300–0200.

A two–beam slotted leaky waveguide array for mobile reception of dual polarization DBS; Department of Electric and Electronic Eng. Tokyo Institute of Technology.

DUAL POLARIZED SLOTTED ARRAY ANTENNA

RELATED APPLICATIONS

This application is a continuation-in-part application of a application, Ser. No. 08/903,678, filed Jul. 31, 1997 also assigned to Electromagnetic Sciences Inc., now U.S. Pat. No. 6,028,562.

FIELD OF THE INVENTION

The invention is generally directed to a slotted array antenna for communicating electromagnetic signals and, more particularly described, is a ridged waveguide-implemented planar array antenna using improved ridged waveguide slot radiators to communicate electromagnetic signals with simultaneous dual polarization states.

BACKGROUND OF THE INVENTION

Slotted array antennas commonly use a waveguide distribution network for distributing RF energy to and from an array of slots placed along the broad wall of a waveguide channel. These waveguide-implemented antennas can be used for communication applications requiring space-limited mountings, such as in aircraft installations. In satellite communications applications, however, it is often a requirement that the antenna be capable of transmission and reception of signals having two different characteristic polarization states. This requirement can prove to be a significant obstacle to designing a space-limited slotted array antenna. Moreover, satellite applications often require a light-weight antenna design, capable of communicating signals with dual polarization states.

Dual polarization communication can be effected by the use of a pair of separate spaced-apart antennas, each having a corresponding polarization state different from the other. However, using a pair of differently polarized antennas often fails to satisfy the need to conserve installation space for a space-limited application. A space-saving alternative is to utilize a single slotted antenna to receive dual polarization signals, by implementing the concept of polarization diversity. Thus, a single slotted antenna capable of communicating signals with polarization diversity (having two characteristic polarization states) can obviate the need for two physically separated antennas.

A previously proffered solution for communicating information with dual characteristic polarization states is an interlaced combination of a pair of slot antennas. A first antenna having slots along the broad wall of a waveguide channel is integrated in a single antenna structure with a second antenna having slots along the narrow wall of a waveguide channel. The slots of the first antenna are associated with a particular polarization state, while the slots of the second antenna are associated with a separate polarization state. Although this interleaving of separate slot antennas into a single, integrated antenna structure can support the communication of dual polarized information, the antenna design also requires the use of end-feed networks with complex designs and interlaced antennas having different frequency responses. In addition, this stacking of broad and narrow wall waveguide channels in an interleaved manner can be difficult to manufacture. The interleaving of a pair of broad/narrow wall waveguide antennas to achieve the communication of dual polarized information generally results in increased design complexity and a difficult manufacturing process.

Another available dual polarized antenna comprises dual polarized slot radiators in bifurcated waveguide arrays. The radiating element comprises a pair of crossed slots in the side wall of a bifurcated rectangular waveguide that couples even and odd waveguide modes. One linear polarization is excited by the even mode, and an orthogonal linear polarization is excited by the odd mode. This antenna design suffers from the disadvantage of requiring an end-feed network rather than the preferred center or rear-feed network of typical slotted array antennas. In addition, manufacturing the antenna requires a relatively complex operation for cutting or stamping out the crossed-slot radiating elements in the side wall of the bifurcated rectangular waveguide.

Another prior antenna design relies upon a small circular hole or an "X"-shaped slot located in the broad wall of a rectangular waveguide, approximately half-way between the center line and the narrow wall. A righthand circular polarization can be achieved by feeding the waveguide from one end. In contrast, a left-hand circular polarization can be achieved by feeding the waveguide from the opposite end. This design suffers from the disadvantage of requiring two separate end-feed networks, rather than the preferred single center or rear-feed network of typical slotted array antennas.

Yet another antenna design communicates signals with dual simultaneous polarization states, by utilizing a cavity section positioned between input and output slots of a ridged-waveguide implemented slot radiator. The cavity section is effective to rotate the polarization of a signal with respect to the relative positions of the input and output slots. Thus, the shape of the cavity section can be utilized to rotate an electromagnetic field from a first polarization state to a second polarization state. In transmit mode, for example, the output slot will receive the electromagnetic signals having the second polarization state and radiate the electromagnetic signals into free space. Various shapes of the cavity section can be used to alter performance characteristics of the radiator, such as impedance matching. However, this design requires a feed network for feeding into the ridge side of the ridged waveguide. Such a feed network requires a complex design and an expensive machining operation. This design is also difficult to implement in a space and/or weight sensitive application, because the complex feed network adds thickness and weight to the overall antenna structure.

Therefore, there exists a need for a dual polarized slotted array antenna capable of supporting simultaneous dual polarization states while utilizing a conveniently manufactured and light-weight feed network. There also exists a need for a dual polarized ridged waveguide-implemented antenna employing a planar array of slots, which can be efficiently and readily manufactured using conventional manufacturing techniques. There is also a need for an improved waveguide slot radiator to support the reduction of the profile of a single structure slotted array antenna capable of supporting simultaneous dual polarization states.

SUMMARY OF THE INVENTION

The present invention provides significant advantages over the prior art by providing an electromagnetic communication system for achieving simultaneous dual polarization electromagnetic signals within a single antenna structure. This objective is accomplished by the use of a ridge waveguide slot radiator formed by a relatively thin cavity section placed between an input slot and an output slot. Polarization diversity can be achieved by rotating the position of the output slot relative to the position of the input slot.

The present invention comprises a slot (the "input slot") that feeds a cavity section which, in turn, feeds a rotated radiating slot (the "output slot"). The input slot can receive electromagnetic signals having a first polarization state from the waveguide and passes these signals to the cavity section. The cavity section includes a first opening positioned adjacent to the input slot and a second opening positioned adjacent to the output slot. The cavity section is operative to rotate the electromagnetic field from the first polarization state to the second polarization state and to provide an impedance match for efficient transmission of the signal from the input slot to the output slot. The output slot responds to the electromagnetic signals having the second polarization state and radiates these electromagnetic signals into free space.

For a ridged waveguide-implemented slotted array antenna, a typical broad wall, shunt slot radiator provides linear polarization perpendicular to the axis of the waveguide. The input slot can be implemented as a shunt slot, located on the ridge wall of the waveguide, for directing electromagnetic signals having the first polarization state into the cavity section. These electromagnetic signals are typically distributed to the input slot via a waveguide assembly which, in turn, can be fed from the broad wall, opposite the ridge, by a rear-feed distribution network. The output slot comprises a slot rotated relative to the position of the input slot and responsive to electromagnetic signals having the second polarization state. The field rotation can take place in a cavity section which is much less than one wavelength thick. Consequently, the additional cavity section and the output slot have little effect on the overall array thickness or weight of a slotted array antenna employing this waveguide slot radiator design. For example, both the cavity section and the output slot can be machined into a single sheet of aluminum, adding only a single thin layer to a standard waveguide slot array antenna.

Typically, this radiating element structure is optimized for connection into the ridge wall of a ridge waveguide. The position of the input slots, typically offset from the centerline of the ridge wall, and the length of the input slots can be varied to achieve the proper excitation of the shunt slot radiators. A reactive tuning stub resonates the slot at the proper frequency, while conveniently providing mechanical support.

A waveguide-implemented single structure antenna can be constructed using a planar array of waveguide slot radiators. The antenna includes multiple waveguide assemblies, each consisting of two broad walls and two narrow walls connected to form a rectangular shaped tube. A rectangular shaped or "T" shaped ridge can run along the inside of one broad wall to allow a reduction in the physical width of the waveguide channel. The broad walls of the waveguide assemblies can be formed by flat plates which may contain slots to allow signals to pass into and out of the waveguide assemblies. A series slot plate forms the broad wall opposite the ridge and an input slot plate forms the broad wall on the ridge side. The input slot plate comprises a planar array of input slots for receiving electromagnetic signals having a first polarization state from each waveguide channel. Another plate, commonly described as a radiator plate, is positioned adjacent to the face of the input slot plate and includes an array of slots comprising a combination of cavity sections and output slots. The cavity sections have a one-to-one relationship with the output slots, and are typically positioned along the rear surface of the radiator plate. In contrast, the output slots are typically placed on the face of the radiator plate and are coupled to the cavity sections. By aligning the input slot plate with the radiator plate, an array of waveguide slot radiators is created, each comprising aligned combinations of an input slot, a cavity section, and an output slot.

Each cavity section of the radiator plate is associated with one of the output slots and comprises a first opening and a second opening. The first opening is positioned adjacent to one of the input slots to allow the cavity section to accept the electromagnetic signals having the first polarization state from the input slot. The second opening is positioned adjacent to one of the output slots to allow the cavity section to pass the electromagnetic signals having the second polarization state to the output slot. The cavity section can be viewed as a transitional section of transmission line, located between the input slot and the output slot, for rotating the polarization of electromagnetic signals from the first polarization state to the second polarization state, and for passing the electromagnetic signals efficiently from the input slot to the output slot. Each output slot receives electromagnetic signals having the second polarization state from the cavity section, and responds by radiating electromagnetic signals of the second polarization state to free space. To achieve a change in the polarizationof the electromagnetic signals, the output slots are typically rotated in position relative to the input slots.

For one aspect of the present invention, a 45° slant left polarization slot array can be interlaced with a 45° slant right polarization slot array within a common antenna structure to provide the capability of transmitting and receiving simultaneous dual orthogonal linear polarization states. This can be accomplished by alternating the placement of side-by-side waveguide assemblies, the first waveguide assembly comprising waveguide slot radiators for communicating electromagnetic signals of a selected polarization state (e.g., 45° slant left) and the second waveguide assembly comprising waveguide slot radiators for communicating electromagnetic signals of another selected polarization state (e.g., 45° slant right). Consequently, the present invention can support the implementation of a slotted array antenna comprising interlaced slotted arrays within a common antenna structure for communicating signals having simultaneous dual orthogonal polarization states. The signals exhibiting dual orthogonal polarization states can have the same frequency range or different frequency bands.

For another aspect of the present invention, a slotted array antenna can be formed by interlacing a slotted array exhibiting a first polarization state with a slotted array exhibiting a second polarization state within a common antenna structure to support the communication of electromagnetic signals having a pair of arbitrary polarization states. This can be accomplished by alternating the placement of side-by-side waveguide assemblies, the first waveguide assembly comprising waveguide slot radiators for communicating electromagnetic signals of the first arbitrary linear polarization state and the second waveguide assembly comprising waveguide slot radiators for communicating electromagnetic signals of the second arbitrary linear polarization state. The pair of arbitrary linear polarization states can be associated with the same frequency band or with different frequency bands.

For a further aspect of the present invention, a slotted array antenna can be implemented as a single slotted array for supporting the communication of electromagnetic signals exhibiting a signal polarization state. In contrast to the interlaced array designs discussed above, this antenna design is characterized by a non-interlaced array of waveguide slot radiators, each comprising an input slot, a transitional cavity section, and an output slot. The transitional cavity section can rotate the polarizationstate of electromagnetic signals passing between the input slot and the output slot. This slotted array antenna is useful for both receiving and transmitting electromagnetic signals having a single polarization state.

In view of the foregoing, these and other advantages of the present invention will become apparent from the detailed description and drawings to follow and the appended claim set.

DETAILED DESCRIPTION

Figure 1:
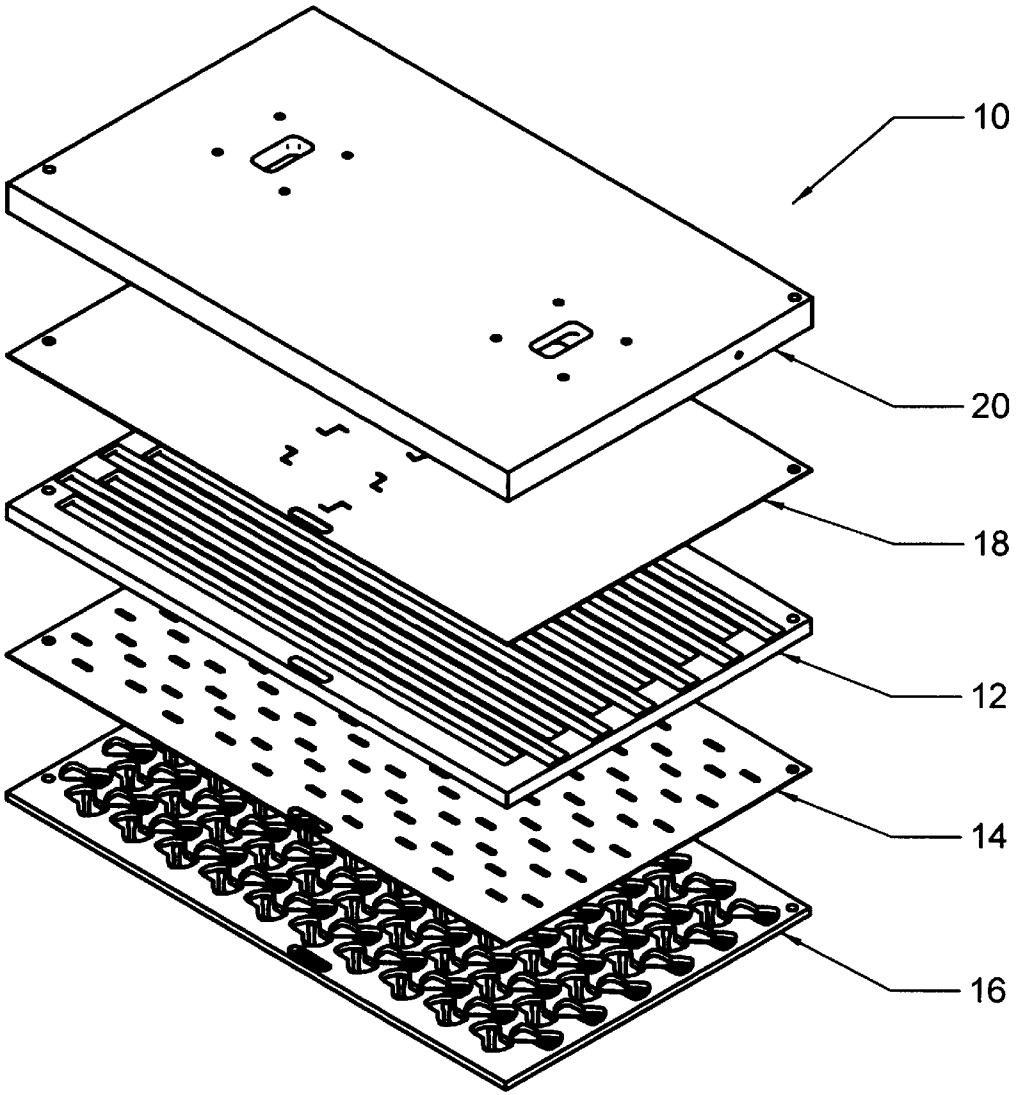
FIG. 1 is an exploded view showing the assembly of an antenna of an exemplary embodiment of the present invention.

The present invention provides a ridged waveguide-implemented antenna including a planar array of improved waveguide slot radiators for communicating electromagnetic signals exhibiting simultaneous dual polarization states. The antenna can be implemented in a single antenna structure by interleaving alternate waveguide assemblies, each supporting one of a pair of orthogonal polarization states. For example, an array of waveguide assemblies having 45° slant left waveguide slot radiators can be interlaced with an array of waveguide assemblies having 45° slant right waveguide slot radiators within a common antenna structure to support the transmission and reception of electromagnetic signals having simultaneous dual orthogonal linear polarization states. Each waveguide slot radiator is implemented by a transitional cavity section positioned between an input slot and an output slot. The output slot can be rotated in position relative to the input slot to change the polarization of electromagnetic signals passed between these slots. The input slots can be located in the ridge wall of the ridged waveguide (rather than the broad wall) enabling the use of a simple, lightweight feed network. Thus, the present invention can support the simultaneous communication of orthogonal polarization signals using a single, lightweight antenna structure.

An exemplary embodiment of the present invention uses a pair of interlaced slotted antenna arrays to form a single structure antenna capable of simultaneous communication of dual polarization signals. In essence, two different antennas, each supporting the communication of a different polarization state, are interlaced to form a single structure antenna. The interlaced arrays can operate at the same frequency or, alternatively, each array can operate at different frequencies to support communication applications requiring different receive/transmit frequencies. This single structure antenna implementation is based on a resonant slot array design supporting rear or center-feed distribution networks for the waveguide-implemented antenna. In this manner, a low-profile antenna can be constructed for use in applications having space limitations and requiring the reception and/or transmission of dual polarization signals. Alternate embodiments can support the communication of signals exhibiting linear or circular polarization states.

Generally described, this single structure antenna design is comprised of a waveguide channel plate, a series slot plate, a ridge plate, an input slot plate and a radiator plate. The waveguide channel plate preferably comprises a waveguide power distribution network and feed ports. A set of parallel ridged waveguide assemblies are formed by the combination of a ridge plate, a series slot plate and an input slot plate. Each ridged waveguide includes two broad walls and two narrow walls connected to form a rectangular shaped tube. A rectangular shaped or "T" shaped ridge runs along the inside of one of the broad walls to allow a reduction in the required physical width of the waveguide. Conductive tuning buttons spanning between a side wall and the ridge can be located at predetermined intervals along the waveguide channel to provide a means for adjusting the resonant frequency of slots in the ridge side of the waveguide and to provide structural support between the ridge and the side walls.

Typically, the side walls and the ridge are formed in a single plate called the ridge plate, using the tuning buttons for structural support between the ridge and the side walls. The series slot plate is typically positioned opposite and parallel to the face of the ridge wall of the waveguide and perpendicular to the side walls. The input slot plate is typically positioned adjacent to the ridge and perpendicular to the side walls. Those skilled in the art will appreciate that the waveguides formed by the ridge plate sandwiched between the series slot plate and the input slot plate forms a parallel set of ridged waveguides. The input slot plate comprises a planar array of input slots, typically constructed as shunt slots extending along the propagation axis of the ridged waveguide. The input slots, typically having a substantially rectangular shape, are cut within the input slot plate and can receive electromagnetic signals having a first polarization state from the ridged waveguide channels.

Advantageously, the waveguide assemblies can be fed by a waveguide-implemented distribution network mounted to the rear of the antenna. This type of feed distribution network can pass signals to and from feed ports positioned along each waveguide channel of the waveguide channel plate. Alternatively, the waveguide assemblies can also be fed by a distribution network mounted at the ends of the waveguide channels. Although this description will refer to transmitting or receiving, independently, it will be appreciated that the antenna of the present invention can be used to do both.

The combination of the ridge plate, the series slot plate and the input slot plate forms ridged waveguide structures including input slots cut within the ridge wall of the waveguide structure. Although the input slots are preferably placed along a ridge wall of each waveguide structure, it will be appreciated that the input slots could also be implemented as "edge wall" slots located in the sidewalls of the waveguide. The waveguide structure is not limited to a particular type of waveguide configuration, but is preferably implemented as either ridge waveguide or rectangular waveguide.

A radiator plate, typically positioned adjacent to the face of the input slot plate, includes a planar array of cavity sections and output slots. The cavity sections are positioned along the rear surface of the radiator plate, whereas the output slots are cut within the front surface of this plate. Each cavity section is associated with an output slot and comprises a first opening and a second opening. The first opening is positioned adjacent to a corresponding input slot in the input slot plate and the second opening is located adjacent to the corresponding output slot. Each cavity section receives electromagnetic signals of the first polarization state from the input slots and rotates the polarization to the second state. Each output slot receives electromagnetic signals of the second polarization state from the cavity sections and radiates these signals into free space. To achieve this change in polarization states, the output slots are typically rotated in position with respect to the input slots, with the cavity section operating as a transitional transmission line section between the input and output slots. In view of the foregoing, it will be appreciated that an array of waveguide slot radiators is created by combining the input slot plate with the radiator plate.

Prior to discussing the embodiments of the antenna provided by the present invention, it will be useful to review the salient features of an antenna formed by a planar array of waveguide slot radiators. An attractive feature of the slot as a radiating element in an antenna system is that an array of slots may be integrated into a feed distribution system without requiring any special matching network. For example, an energy distribution network, typically formed in a waveguide or stripline transmission medium, typically provides energy to each radiating element. Low-profile, high-gain antennas can be configured using slot radiators, although such antennas are generally bandwidth-limited by input VSWR performance.

A slot cut into the wall of a waveguide interrupts waveguide wall current flow and will couple energy from the waveguide into free space. Waveguide slots may be characterized by their shape and location on the wall of the waveguide and by their equivalent electrical circuit elements. A slot cut into the broad wall of a waveguide and oriented parallel to the propagation direction may be represented equivalently by a two terminal shunt admittance. These slots are typically offset from the centerline of the waveguide and interrupt only transverse currents. These slots are commonly known as shunt slots. By comparison, a slot cut into the center of the broad wall of a waveguide may be represented by a two terminal series impedance. These slots are cut at an angle between zero and ninety degrees relative to the propagation direction. These slots are typically centered in the broad wall at an angle between zero and ninety degrees relative to the propagation direction. These slots are commonly known as series slots. Equivalent circuit admittance and impedance values for particular shunt and series slots may be determined with the aid of measured data and design equations that are well known to those persons skilled in the art.

After individual slot element characteristics have been determined, the designer of a linear resonant slot array must specify shunt slot locations and resonant conductances. This supports the design for an antenna impedance match and determines the aperture distribution. Slot spacing is limited by the appearance of grating lobes as slot spacings increase toward one free-space wavelength and by the requirement that all slots be illuminated in-phase. To meet both requirements simultaneously, slots are typically spaced at one-half of the guide wavelength along the waveguide centerline and on alternating sides of the centerline. The waveguide size is chosen such that the guide wavelength is typically between 1.4 and 1.6 free space wavelengths. An array of shunt slots in the broad waveguide wall spaced in this manner will produce radiation polarized perpendicularly to the waveguide axis.

The basic building block of a linear resonant slot array is a single waveguide section fed from either end or the rear of the waveguide. The number of slots in the waveguide is practically limited by input VSWR bandwidth and by array pattern requirements. Basic design requirements include: (1) the sum of all normalized slot resonant conductances are nominally made to be equal to 2 for a center feed (or 1 for an end feed), and (2) the radiated power from each slot location is proportional to that slot's resonant conductance. The sum of all normalized slot resonant conductances may purposefully be made different from the matched condition to achieve a greater usable bandwidth or the feed network may have impedance transformation characteristics that can accomplish the matching. In an exemplary embodiment of the antenna described below, the slots are designed to radiate equal power, so the resonant conductance of all slots is designed to be equal.

As stated above, this application is a continuation-in-part of a copending application, Ser. No. 08/903,678, also assigned to Electromagnetic Sciences, Inc. A description of the structure and operation of a waveguideimplemented antenna utilizing slot radiators is provided in that co-pending application. The disclosure of that application is hereby incorporated by reference.

Turning now to the drawings, in which like reference numbers refer to like elements, FIG. 1 is a diagram illustrating an exploded view of the primary components of an exemplary embodiment of the present invention. FIGS. 2A–2B, 3, 4A–4C, 5, 6, 7A–7B, 8, 9, and 10 show various views of the components presented in FIG. 1, specifically a waveguide channel plate, a series slot plate, a ridge plate, an input slot plate, and a radiator plate. Referring generally to FIG. 1, the antenna 10 is particularly useful for wireless communications systems requiring a low profile antenna for limited space applications. This slotted array implementation of the antenna 10 supports low profile applications based on its relatively flat plate appearance and rear-fed distribution network. The antenna 10 is preferably implemented as a single antenna structure employing a pair of interleaved planar arrays of waveguide slot radiators, each planar array supporting one of a pair of polarization states.

An exemplary embodiment of the antenna 10 can be created by the combination of a set of conductive plates, each associated with a particular antenna function. In particular, a waveguide-implemented antenna can be created by the combination of a waveguide channel plate 20 which receives power through an input port and divides it between multiple parallel ridge waveguides, a series slot plate 18 which couples power from the waveguide channel plate 20 to the ridge plate 12, a ridge plate 12 which distributes power to a multitude of waveguide slot radiators, an input slot plate 14 which couples power from the ridge plate 12 to the radiator plate 16 and a radiator plate 16 which rotates the polarization of the power received from the input slots and radiates the power into free space at its new polarization state. The input slots, typically rectangular shaped slots cut within the input slot plate 14, represent shunt-type slots for a conventional slotted array antenna. The radiator plate 16 comprises a planar array of output slots along the front of the plate and cavity sections extending along the rear of the plate, the cavity sections having a one-to-one correspondence with the output slots. The combination of the input slot plate 14 and the radiator plate 16 creates a planar array of waveguide slot radiators, each radiator comprising a relatively thin cavity section positioned between an input slot and an output slot. The cavity section has a thickness range of between 0.03 and 0.2 wavelengths, preferably less than 0.1 wavelengths. A waveguideimplemented feed distribution network passes signals to the ridge plate 12. The feed distribution network is created by the combination of a series slot plate 18 and a waveguide channel plate 20.

Figure 2A:
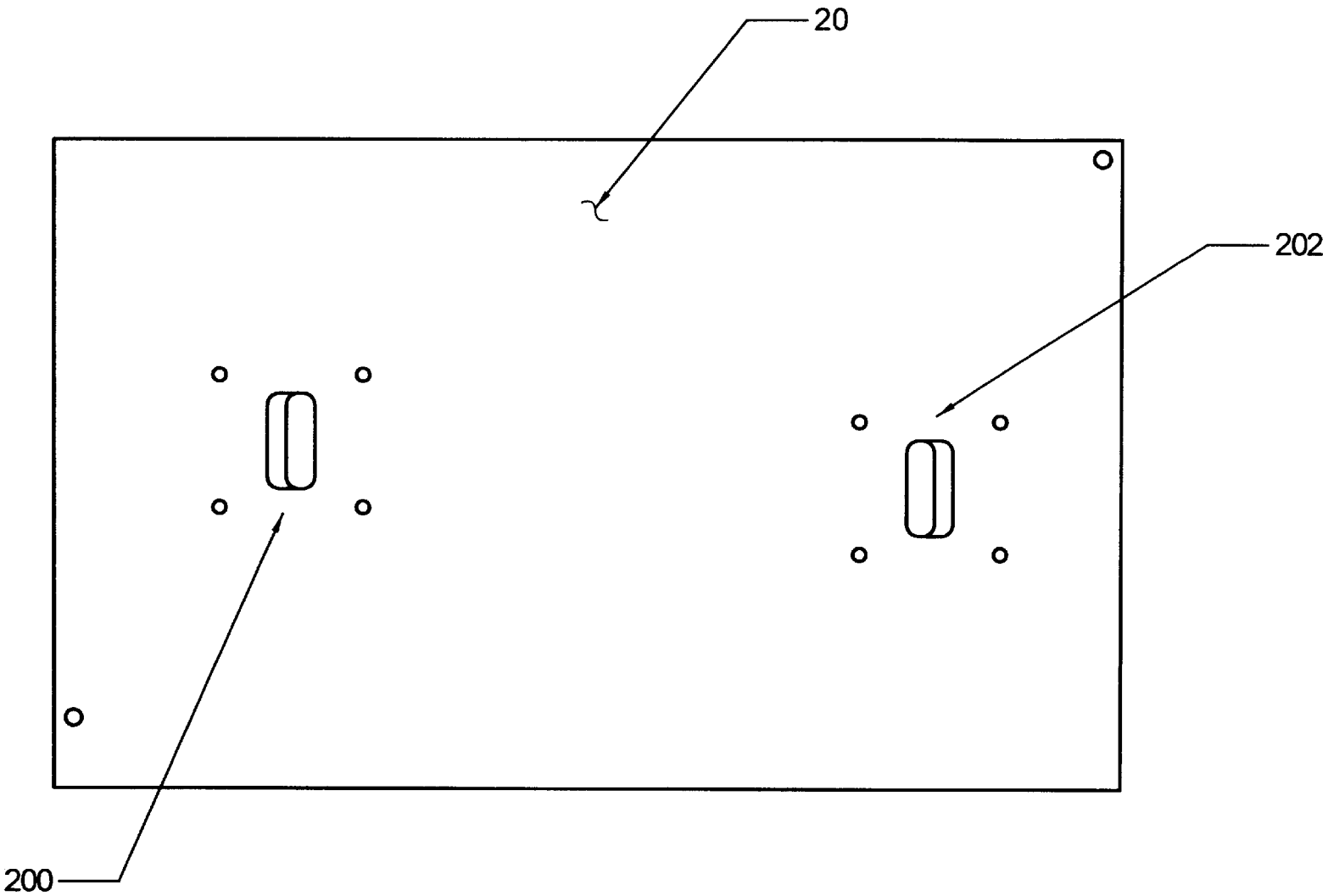
FIG. 2A is an illustration showing a rear view of a plate containing waveguide signal distribution channels for an antenna of an exemplary embodiment of the present invention.
Figure 2B:
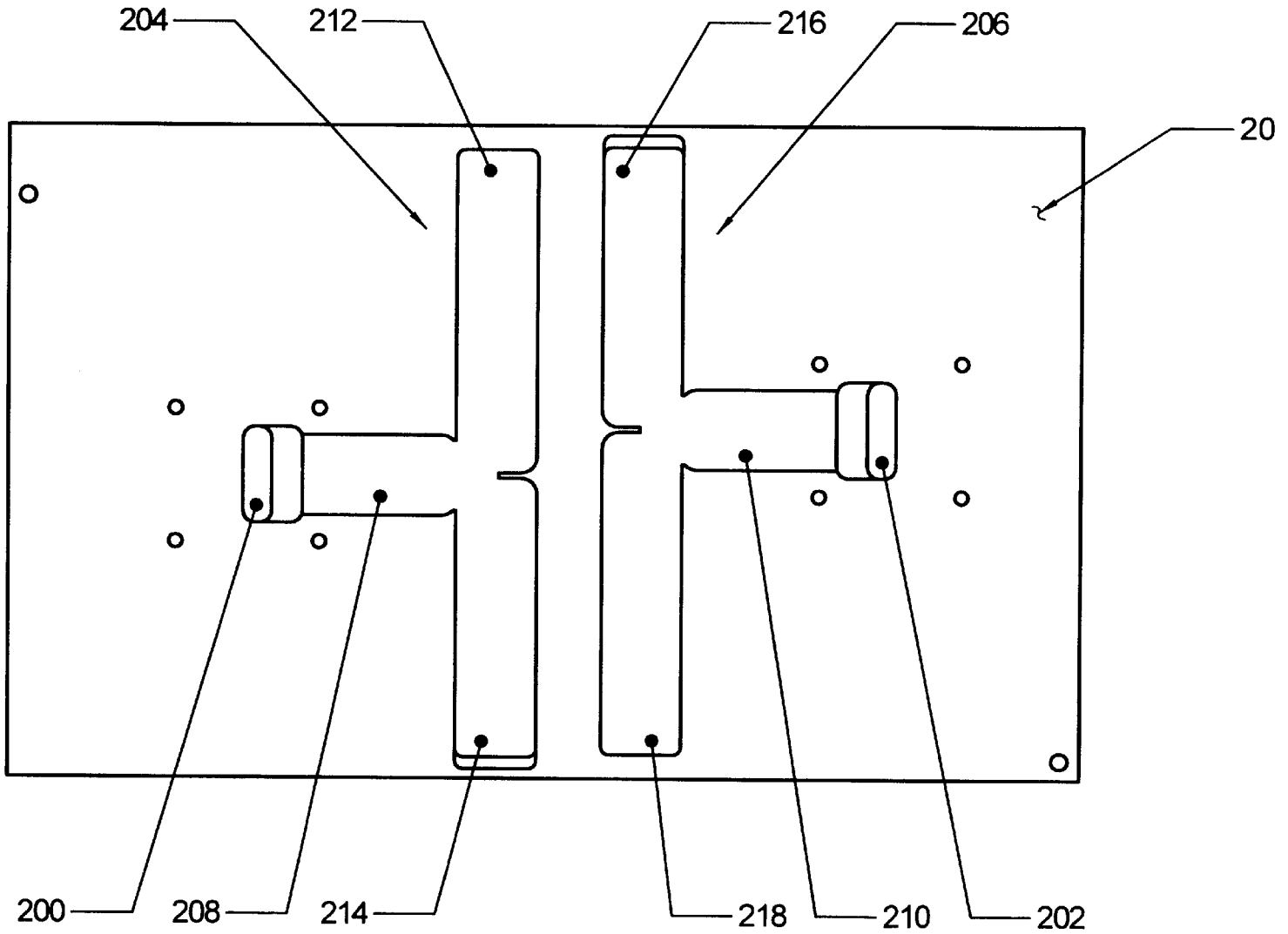
FIG. 2B is an illustration showing a front view of the plate presented in FIG. 2A.

Turning now to FIGS. 2A and 2B, the waveguide channel plate is shown in rear and front views, respectively. FIG. 2A is an illustration of the rear of the waveguide channel plate 20 and depicts two input ports 200, 202 that are bored through the waveguide channel plate 20 to enable the feed of electromagnetic signals to the interleaved antennas. The first input port 200 feeds one of the two interleaved antennas, while the second input port 202 feeds the other.

FIG. 2B is an illustration of the front of the waveguide channel plate 20 and also depicts the input ports 200 and 202. Additionally, FIG. 2B depicts the input tees 204, 206 that distribute the electromagnetic signals to the series slot plate 18 (FIG. 1). The input ports provide an interface to communicate electromagnetic signals from the input ports 200, 202, along the trunk sections 208, 210 of the input tees and into the distribution regions 212, 214, 216, 218. The series slot plate 18 (FIG. 1) forms a cover plate of the input tee waveguides. The series slots in the series slot plate 18 (FIG. 1) interrupt the input tee waveguide wall current flow and couple energy from the input tee waveguide into the ridge plate 12 (FIG. 1) mounted to the front face of the series slot plate 18 (FIG. 1).

Figure 3:
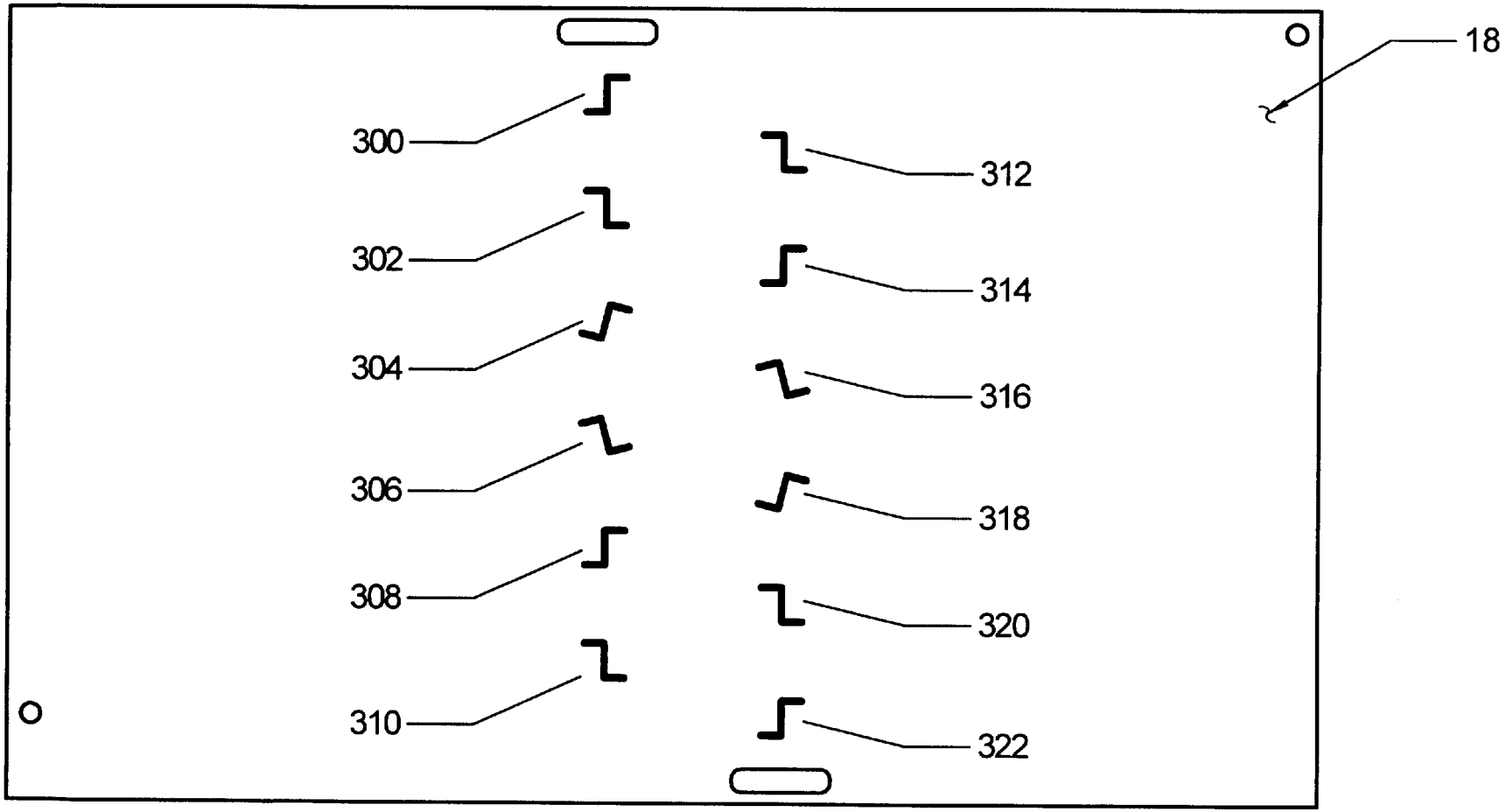
FIG. 3 is an illustration showing a rear view of a plate containing series slots for an antenna of an exemplary embodiment of the present invention.

FIG. 3 is an illustration showing the series slot plate 18. Series slots 300–322 are bored through the series slot plate 18 and couple energy from the input tee waveguide into the ridge plate 12 (FIG. 1). In an exemplary embodiment of the present invention, series slots 300–310 are positioned to correspond to the ridge waveguide channels of the ridge plate 12 (FIG. 1), such that the series slots 300–310 couple energy to only one of the two interleaved antennas. Similarly, series slots 312–322 couple energy to the other interleaved antenna. Notably, series slots 304, 306, 316, and 318 are preferably twisted slightly, to compensate for perturbed waveguide wall currents present due to the close proximity of the tee junction. The tee junction is the interface between the tee trunks 208, 210 (FIG. 2B) and the distribution regions 212, 214, 216 and 218 (FIG. 2B).

Figure 4A:
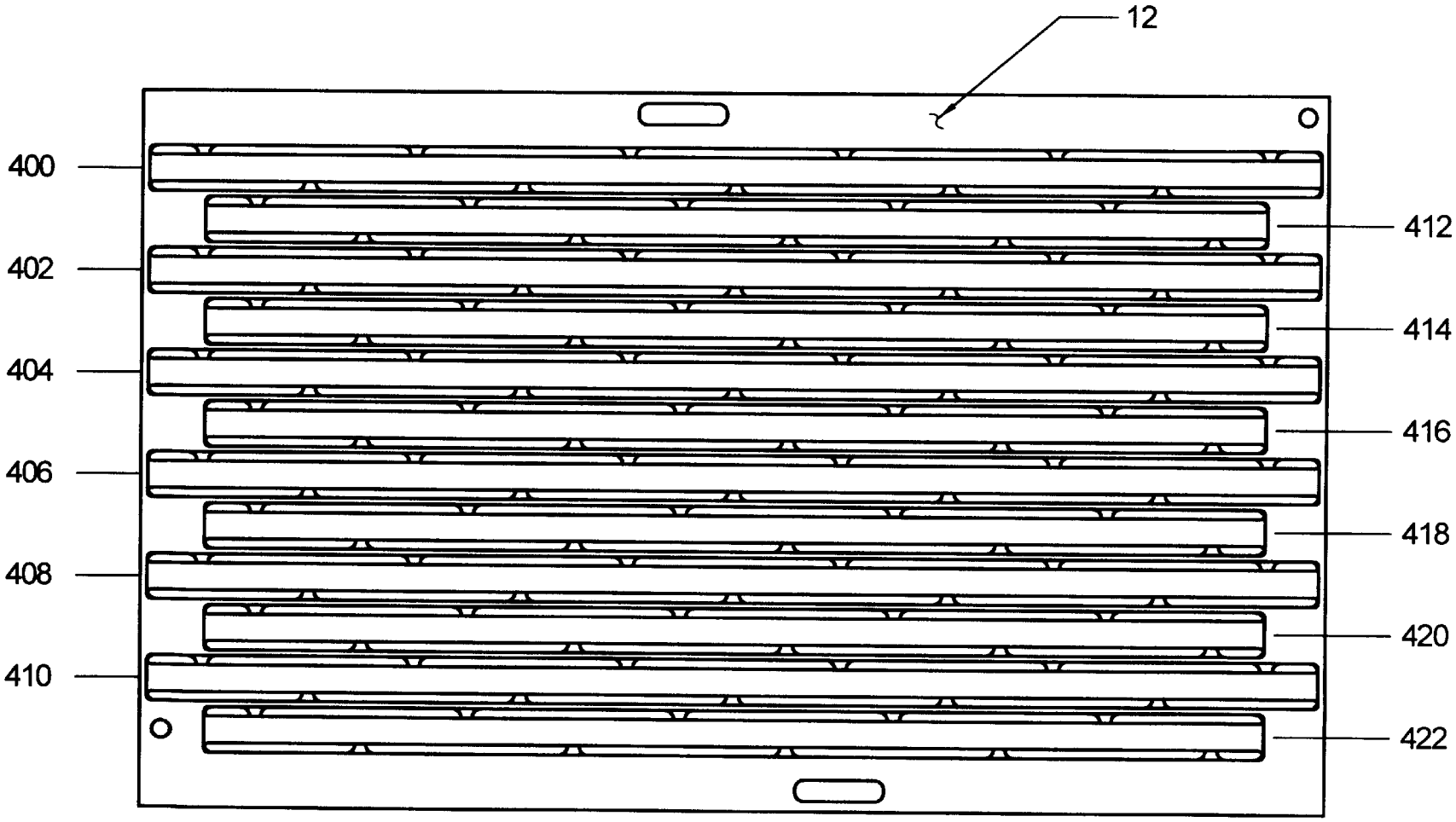
FIG. 4A is an illustration showing a rear view of a ridge waveguide channel plate in accordance with an exemplary embodiment of the present invention.
Figure 4B:
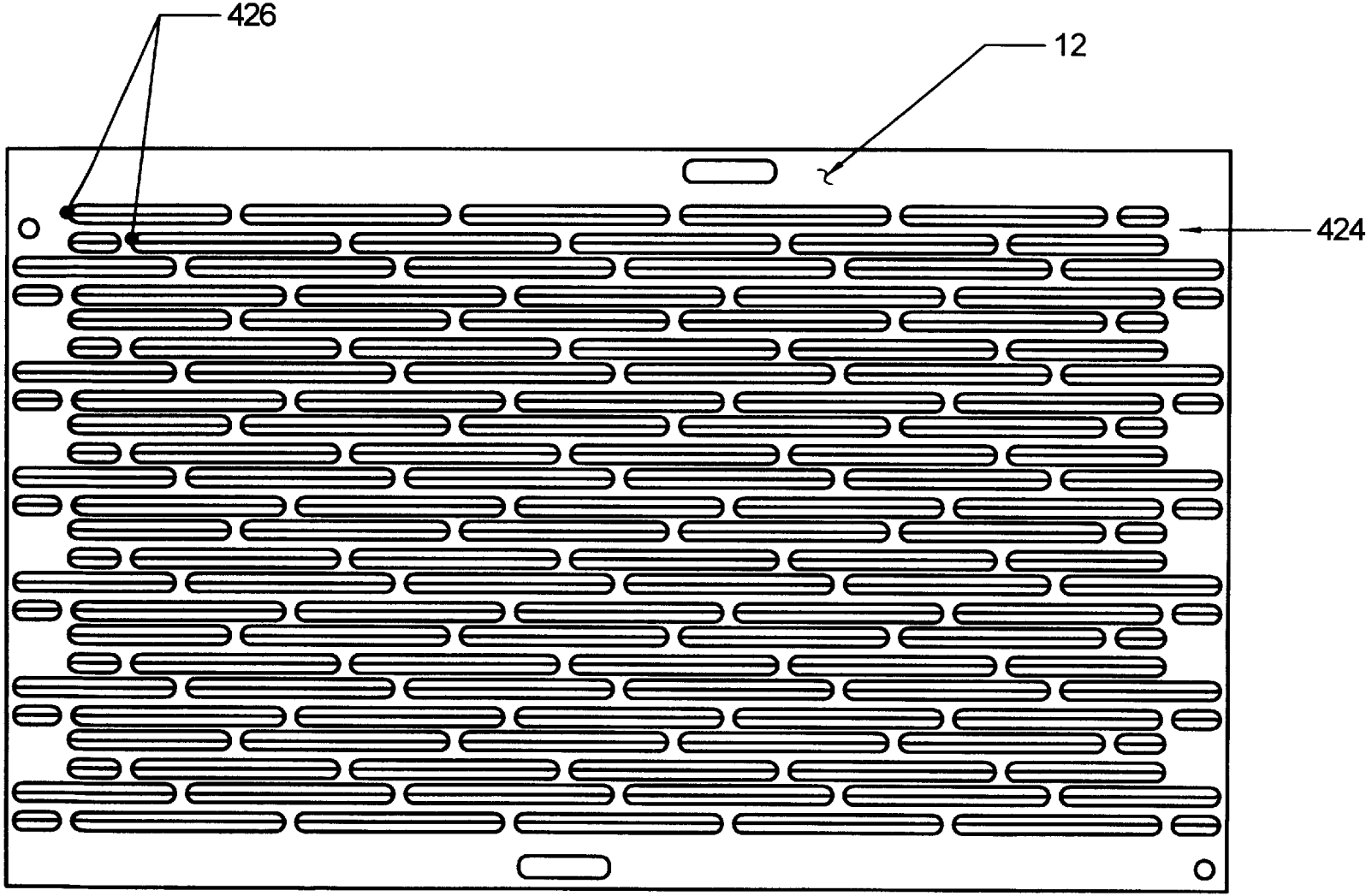
FIG. 4B is an illustration showing a front view of the plate presented in FIG. 4A.
Figure 4C:
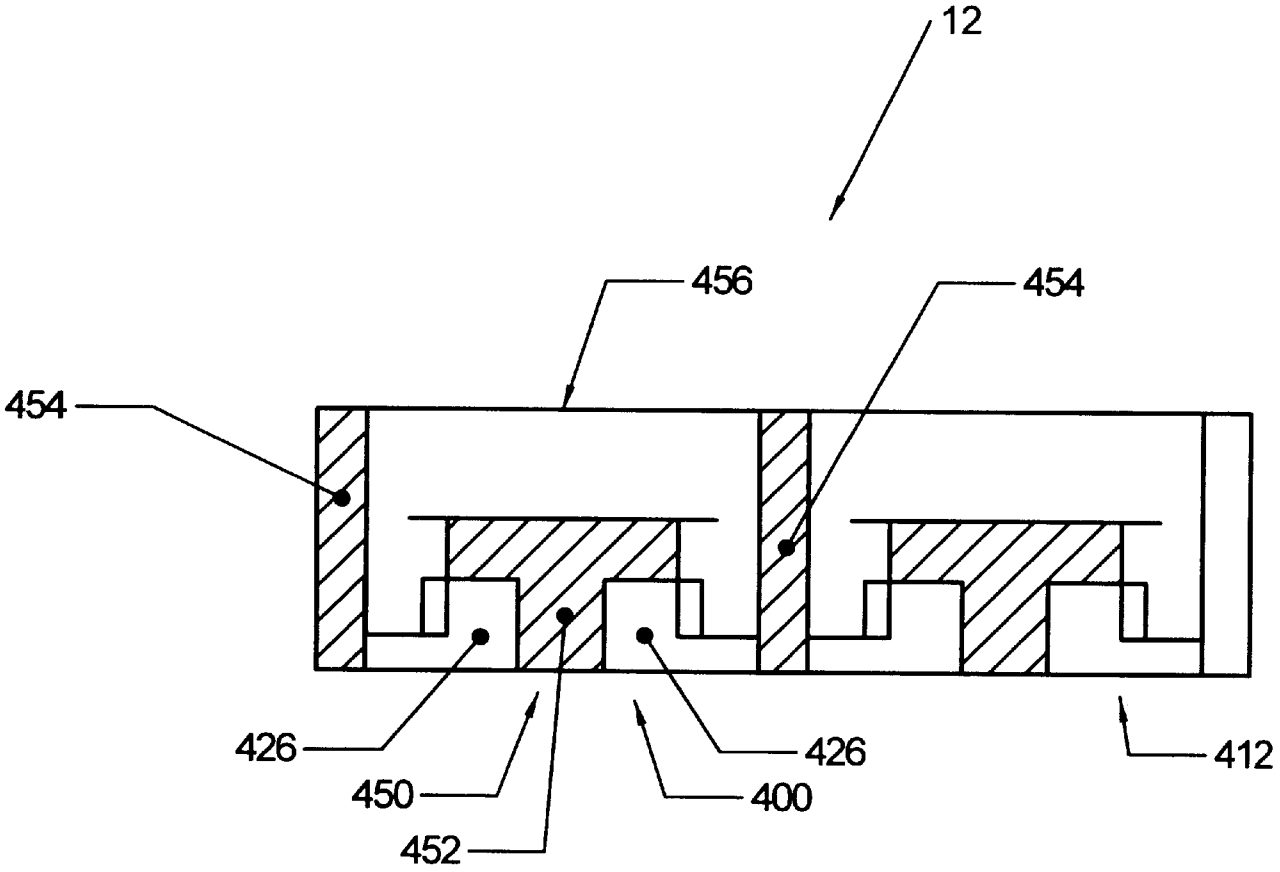
FIG. 4C is an illustration showing an enlarged view of a cross-section of a ridged waveguide channel of the plate presented in FIG. 4A.

FIGS. 4A–4C, collectively described as FIG. 4, are illustrations of the ridge plate 12. FIG. 4A is an illustration of the rear face of the ridge plate 12. This view shows the parallel ridged waveguide channels 400–422 which are cut into the ridge plate 12. Because the antenna 10 is preferably constructed as an interleaved pair of slotted arrays, adjacent waveguide channels (e.g., 400 and 412) are associated with different slotted arrays having selected polarization characteristics. In other words, waveguide channels 400–410 support the communication of electromagnetic signals having a first polarization characteristic and waveguide channels 412–422 support the communication of electromagnetic signals having a second polarization characteristic.

FIG. 4B is an illustration of the front face of the ridge plate 12. This view shows the parallel ridged waveguide channels 400–422 which are cut into the waveguide channel plate 12. This view also shows the ridge 424 of the parallel ridged waveguide channels 400–422. FIG. 4B also depicts the tuning buttons 426 which extend between the side walls and the ridges of the parallel ridged waveguide channels 400–422. Notably, the position of the tuning buttons 426 preferably alternates between side walls of a particular parallel ridged waveguide channel 400–422. That is, adjacent tuning buttons will span between the ridge 424 and opposite side walls. The significance of this design constraint will be discussed in more detail in connection with FIGS. 7A and 7B.

Referring now to FIG. 4C, a cross section of adjacent parallel ridged waveguide channels 400, 412 is illustrated. Each waveguide channel 400, 412 preferably comprises two broad walls 450, 456 and two narrow walls 454 connected to form a rectangular shaped tube. A "T" shaped ridge 452 runs along the inside of one of the broad walls 450 to allow a reduction in the required physical width of the waveguide. As discussed above in connection with FIG. 3, the parallel ridged waveguide channels are fed by series slots 300–322 cut into the series slot plate 18 (which forms the broad wall of the ridged waveguide opposite the ridge). The series slots 300–322 support the distribution of electromagnetic signals into the parallel waveguide structures formed by positioning the series slot plate 18 adjacent to and substantially along the rear face 456 of the ridge plate 12. For the embodiment shown in FIGS. 4A–4C, the connection of the input slot plate 14 and the series slot plate 18 to the ridge plate 12 forms a parallel set of ridge waveguides, each having input slots along the face of the input slot plate 14. The tuning buttons 426 are shown connecting the side walls 454 to either side of the ridge 452. Those skilled in the art will appreciate that the present invention can be implemented with antennas having ridges that are not "T"-shaped (e.g., rectangular shaped ridges).

The ridge plate 12 is preferably constructed from conductive material, such as aluminum stock. The ridge waveguide channels 400–422, in combination with the input slot plate 14 and the series slot plate 18 preferably form ridge waveguide structures. The use of ridge waveguide is preferable for the antenna 10 based on the design requirement of closely-spaced waveguide slot radiators for simultaneous communication of dual polarized signals. This design objective for the exemplary embodiment of FIG. 1 can be satisfied by the relatively narrow waveguide structure of ridge waveguide.

Figure 5:
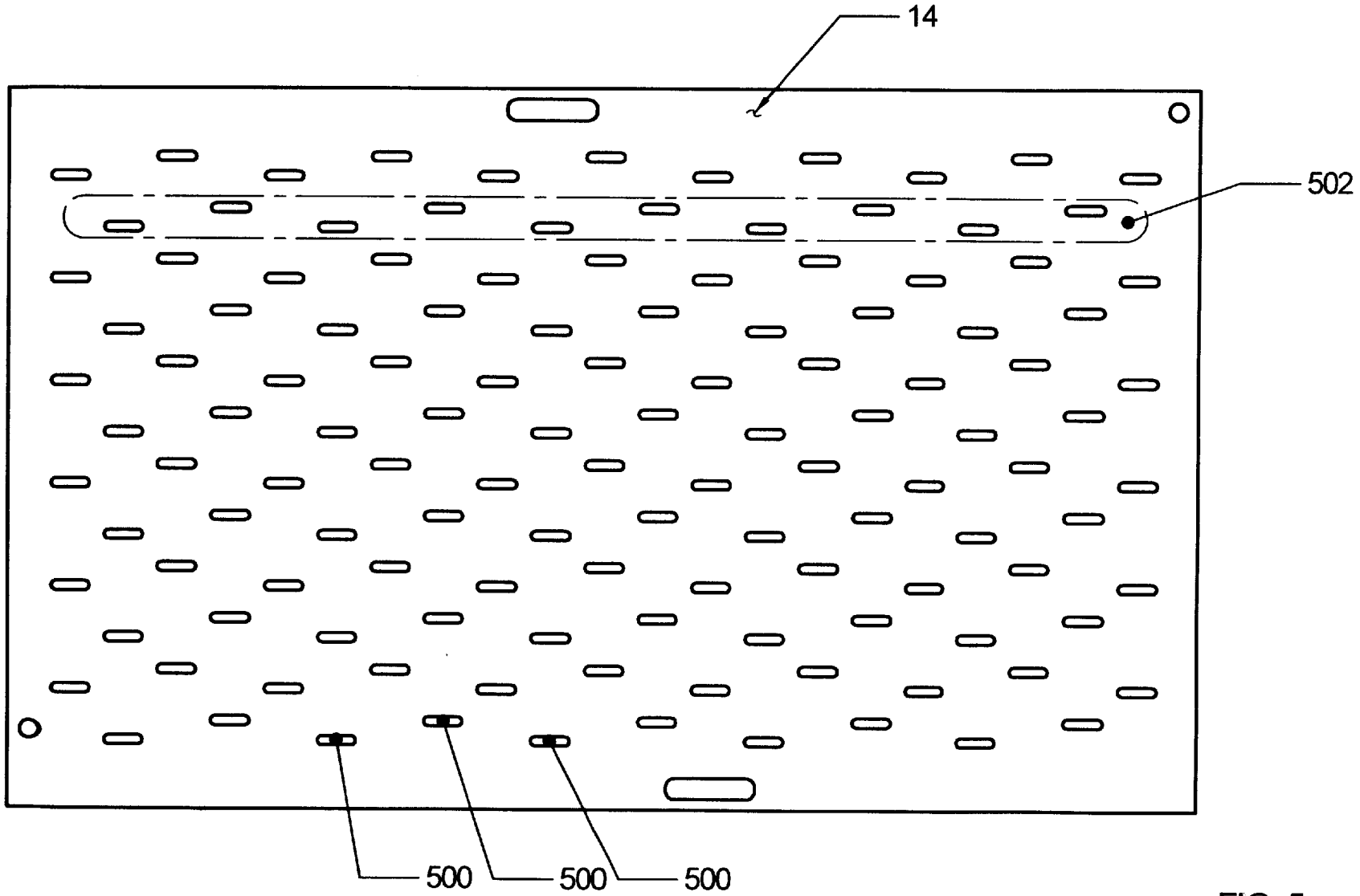
FIG. 5 is an illustration showing a rear view of a plate comprising input slots in accordance with an exemplary embodiment of the present invention.

Referring now to FIG. 5, the input slot plate 14 comprises a planar array of input slots 500 positioned along the face of the plate. The input slot plate 14 is mounted to the front face (ridge wall) of the ridge plate 12 and extends substantially along the length and width of the plate 12. The input slot plate 14 preferably rests along the edges of the side walls 454 of the ridge plate 12. By covering the face of the ridge plate 12 with the input slot plate 14, waveguide structures are formed to support the distribution of electromagnetic signals within the enclosed waveguide channels. Each waveguide structure comprises input slots 500 located on a front wall, which is provided by the input slot plate 14, and series slots 300–322 positioned along a rear wall of the ridge plate 12. For each waveguide structure, a waveguide channel is formed by a front wall with a rectangular or "T"-shaped ridge and a rear wall, which are separated by a pair of spaced-apart, parallel side walls. The preferred waveguide structure is a ridged waveguide. Those skilled in the art will understand that other types of waveguide structures can be used for the antenna 10, including a rectangular waveguide.

The input slots are preferably rectangular-shaped slots, each approximately 0.25 wavelengths long, cut into the input slot plate 14. The length of the input slots controls the amount of electromagnetic energy that can be radiated. Each input slot 500 is associated with only one of the waveguide structures formed by the combination of the ridge plate 12 and the input slot plate 14. An input slot is preferably oriented parallel to the direction of propagation within its corresponding waveguide channel, thereby interrupting only transverse currents in the ridge wall of the waveguide channel. The input slots 500 are positioned along the input slot plate 14 in linear slot arrays 502 of shunt-type slots extending along the horizontal (propagation) axis of the waveguide channel. Specifically, each linear slot array 502 is aligned along the propagation axis of a waveguide channel 400–422 to accept electromagnetic signals distributed from this waveguide channel. The input slots 500 of each linear slot array 502 are offset from a central axis extending along the propagation axis of the corresponding waveguide channel 400–422.

For the exemplary embodiment shown in FIG. 5, twelve parallel linear slot arrays 502 extend along the propagation axis of the ridge plate 12. The input slot plate 14 is preferably constructed from a relatively thin conductive material, such as aluminum stock. The input slots 500 along the propagation axis of a single waveguide channel 400–422 are spaced by approximately 0.76 wavelengths. The spacing between adjacent linear slot arrays 502 is approximately 0.38 wavelengths.

Figure 6:
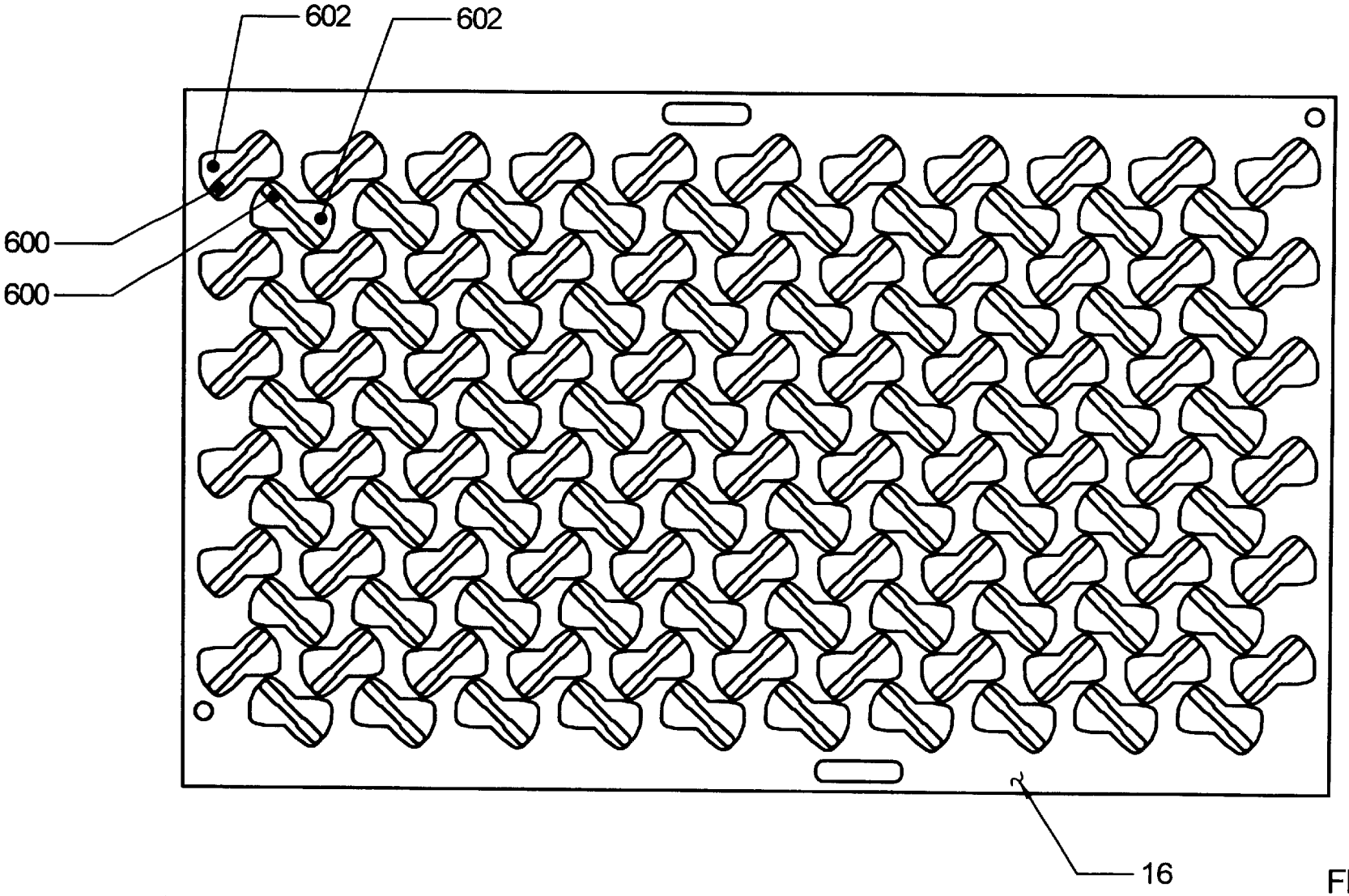
FIG. 6 is an illustration showing a rear view of a plate comprising output slots and cavity sections in accordance with an exemplary embodiment of the present invention.

Turning now to FIG. 6, a pair of representative cavity sections 602 and output slots 600 are respectively positioned along the rear and front surfaces of the radiator plate 16. Each output slot 600 is associated with only one of the input slots 500 on the input slot plate 14 and can be rotated in angle relative to its corresponding input slot. An output slot is typically rotated with respect to its corresponding input slot to accommodate the electric field polarization which rotates as the electromagnetic signals pass between this pair of slots. As will be described in more detail below with respect to FIGS. 8–10, each cavity section 602 is positioned between slots 500 and 600 to form a waveguide slot radiator. The cavity sections 602 represent relatively thin transitional sections that separate the input slots 500 from the corresponding rotated output slots 600. The cavity sections 602 can be modeled as a transmission line for transmitting electromagnetic signals between the slots 500 and 600. The cavity sections 602 also support the matching of impedances presented by the input slots 500 and the corresponding output slots 600. Because the cavity sections 602 are preferably thin transitional sections, typically much less than one wavelength thick, the radiator plate 16 can be constructed from a relatively thin conductive material, such as aluminum plate. Indeed, each cavity section 602 has a thickness of preferably less than 0.1 wavelength.

The output slots 600 are positioned in linear slot arrays (not shown) that extend along the horizontal axis of the radiator plate 16. Each linear slot array is aligned with a corresponding linear slot array 502 to accept electromagnetic signals passed from input slots 500 via the transitional transmission path provided by the cavity sections 602. Different rotation patterns are preferably used for adjacent linear slot arrays. In other words, linear slot arrays having the same rotation pattern can be interleaved on an alternating basis with linear slot arrays having a different rotation pattern. The alternating slot rotation patterns along the plate 16 support the communication of electromagnetic signals exhibiting dual polarization states.

For the exemplary embodiment shown in FIG. 6, every other linear slot array along the vertical axis of plate 16 includes output slots 600 rotated 45 degrees to the right of the corresponding input slots 500. The remaining linear slot arrays include output slots 600 rotated 45 degrees to the left of the corresponding input slots 500. In this manner, signals having orthogonal polarization states can be communicated by a single structure antenna. Specifically, two simultaneous radiation patterns of slant left and slant right polarization states can be supported by the antenna 10 shown in FIGS. 1–6.

Figure 7A:
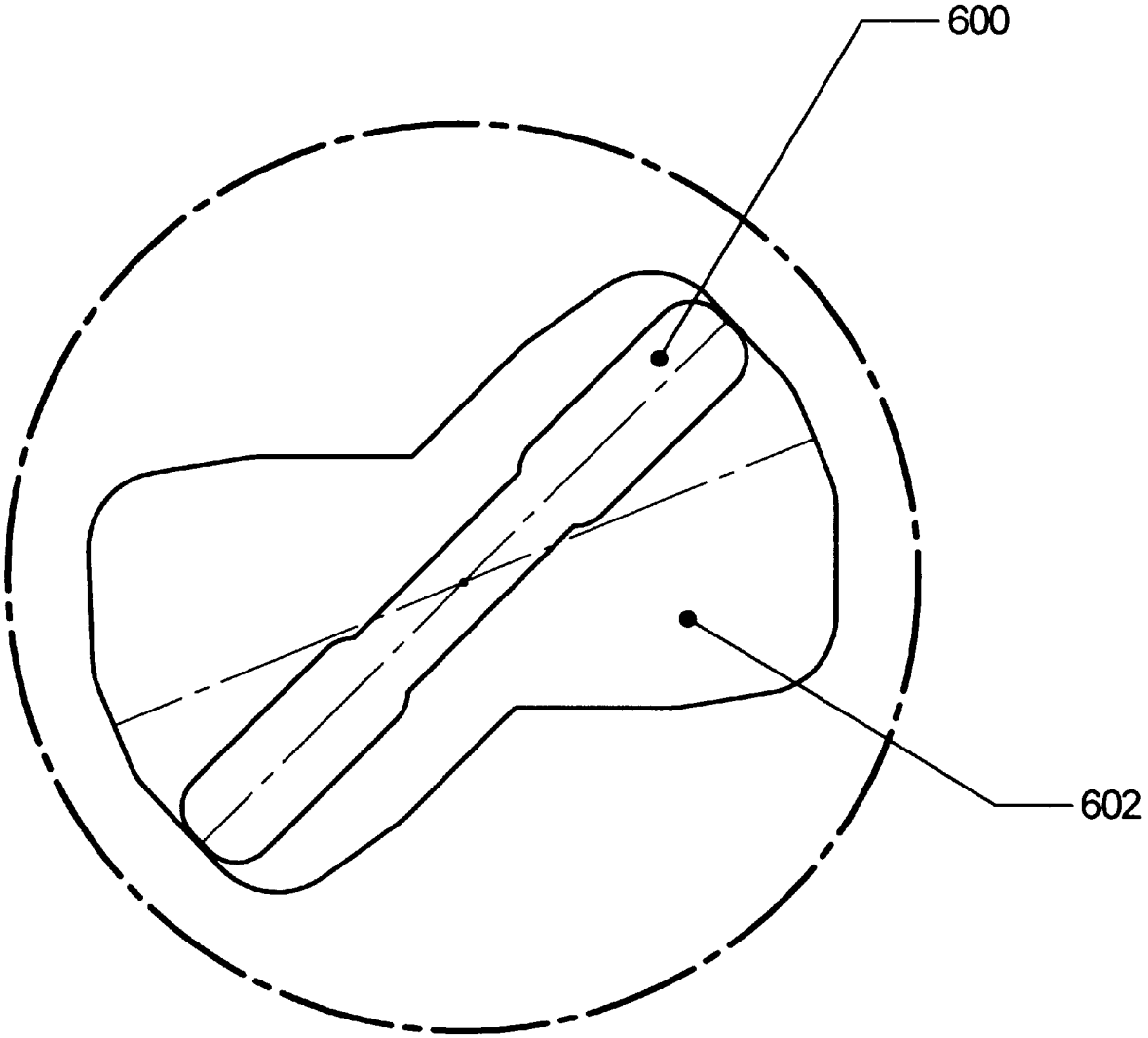
FIG. 7A is an illustration showing an output slot positioned in a slant left orientation with respect to a ridge waveguide axis in accordance with an exemplary embodiment of the present invention.
Figure 7B:
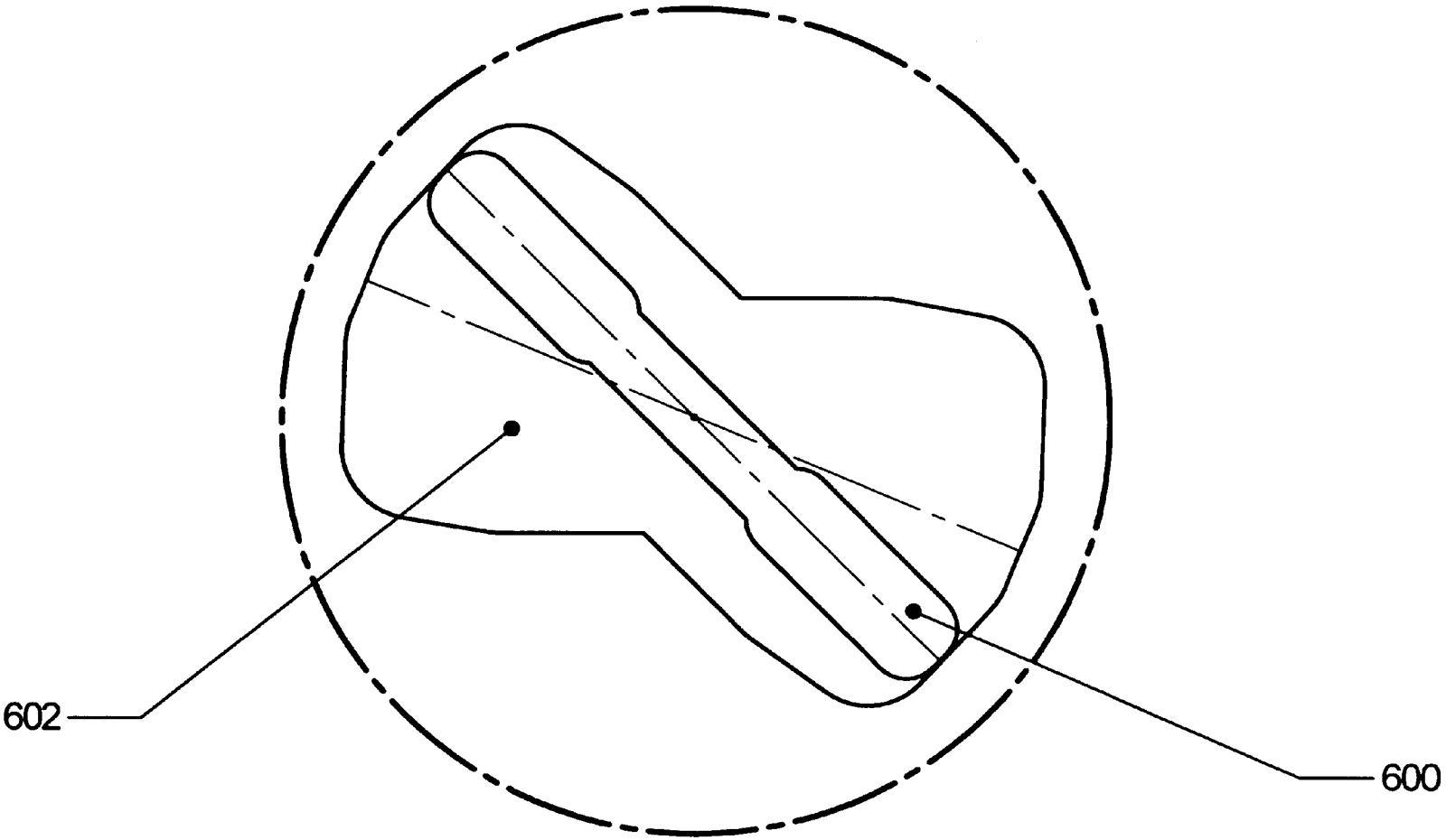
FIG. 7B is an illustration showing an output slot positioned in a slant right position with respect to the ridge waveguide in accordance with an exemplary embodiment of the present invention.

Referring now to FIGS. 7A and 7B, enlarged views of the cavity section 602 and output slot 600 are shown. In FIG. 7A, the position of the output slot 600 with respect to the input slot (not shown) is capable of generating a signal characterized by having a slant left polarization. Similarly, in FIG. 7B, the position of the output slot 600 with respect to the input slot (not shown) is capable of generating a signal characterized by having a slant right polarization. The cavity section 602 preferably has a "bow-tie"-shape because the cavity section assumes the form of a crossed pair of input and output slots 500 and 600. The length of the cavity section 602 is approximately 0.5 wavelength and its width is approximately 0.2 wavelength. The thickness of the cavity section 602 is preferably less than 0.1 wavelength. Notably, an exemplary output slot 600 has a constricted middle section. That is, the ends of the output slot 600 are wider than the middle section. This constriction permits a means of controlling the resonant frequency of the output slot 600.

Because the input slots 500 within a particular linear slot array 502 are offset from the center of each linear slot array 502 in an alternating fashion, the middle portion of the cavity section 602 must be wide enough to accommodate the position of each input slot 500 within a particular linear slot array without alternating the position of the cavity section or output slot within a particular linear slot array 502. Similarly, the position of adjacent tuning buttons (not shown) alternates along the longitudinal axis of each waveguide channel, so that it is adjacent a side wall opposite the input slot 500.

Figure 8:
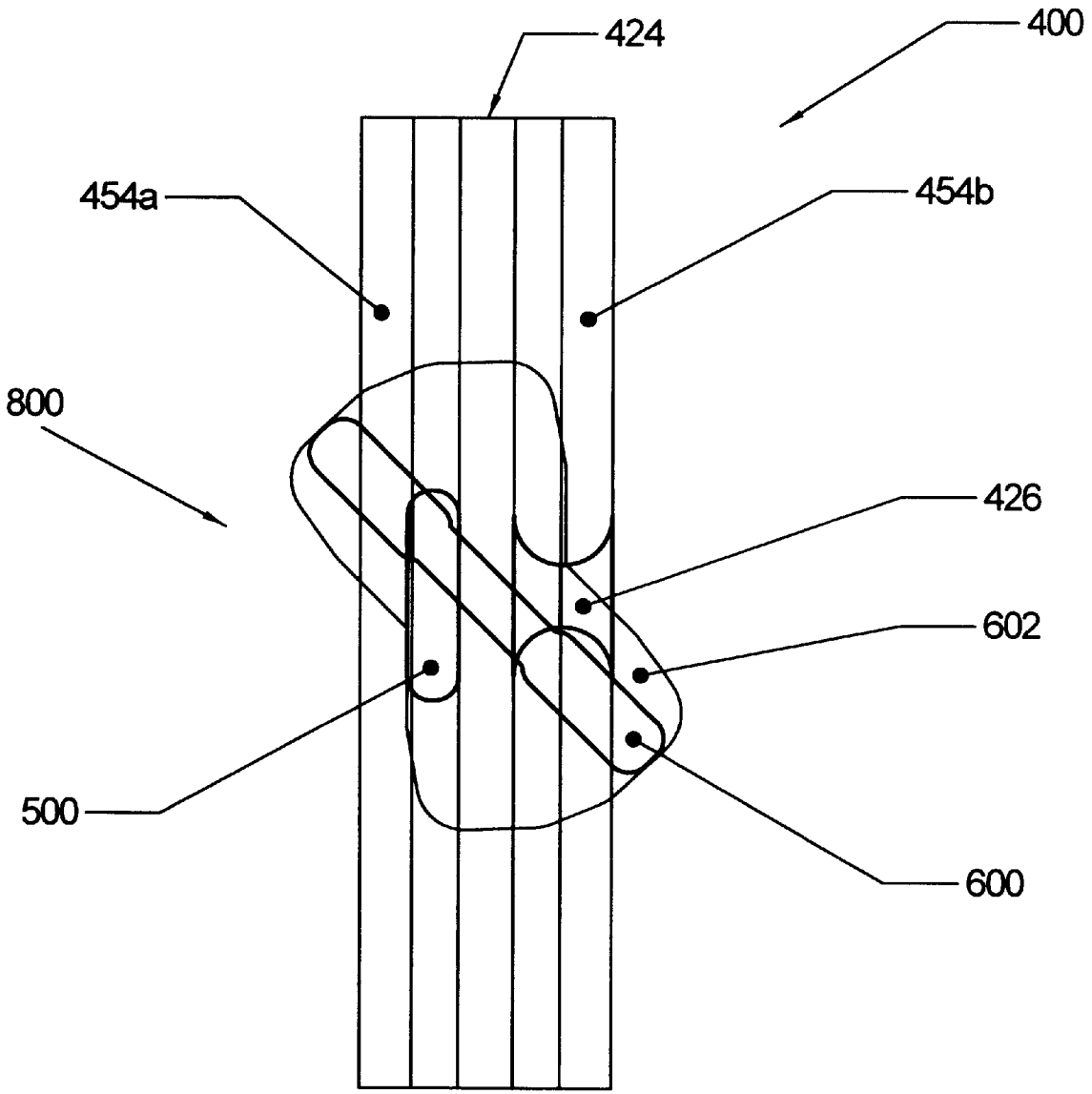
FIG. 8 is an illustration showing a front view of a radiator of an exemplary embodiment of the present invention.

Turning now to FIG. 8, a front view of an exemplary radiating element 800 is depicted. The radiating element 800 includes an output slot 600, a cavity section 602, an input slot 500, and a tuning button 426. The radiating element 800 is shown in the context of an exemplary "T"-shaped ridged waveguide 400. As discussed in connection with FIGS. 6, 7A, and 7B, the output slot 600 is rotated with respect to the input slot 500. The input slot 500 is positioned between the ridge 424 and a first side wall 454*a*. The tuning button 426 is positioned between a second side wall 454*b* and the ridge 424.

Figure 9:
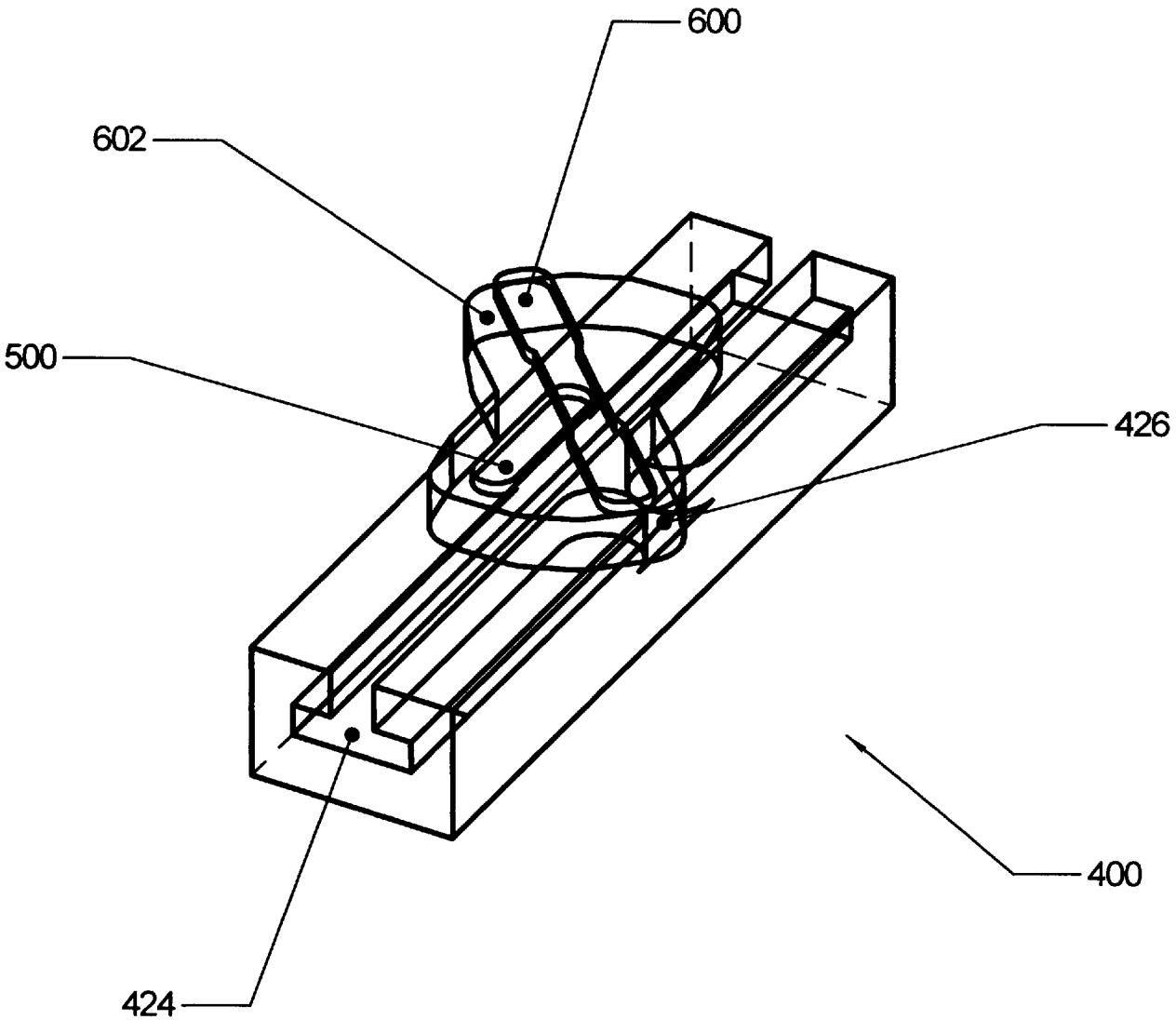
FIG. 9 is an illustration showing a front perspective view of a radiator of an exemplary embodiment of the present invention.

Referring now to FIG. 9, a perspective view of the radiating element 800 is shown, in the context of a ridged waveguide 400. This drawing depicts a negative structure of the radiating element 800. In other words, the "structures" shown are really the air spaces defined by the components of the radiating element 800; the volume outside the depicted "structures" is the conductive material of the antenna. As with FIG. 8, the radiating element 800 includes an output slot 600, a cavity section 602, an input slot 500, and a tuning button 426.

As can be seen from FIGS. 8 and 9, the input slot 500 is significantly shorter than the output slot 600. The length of the input slot is reduced in order to control the radiation amplitude of a particular waveguide slot radiator. However, reducing the length of the input slot 500 results in a need to control susceptance of the radiating element. The tuning button 426 provides the means to control susceptance. Thus, in an exemplary embodiment of the present invention, each radiating element is equipped with a tuning button for this purpose.

Figure 10:
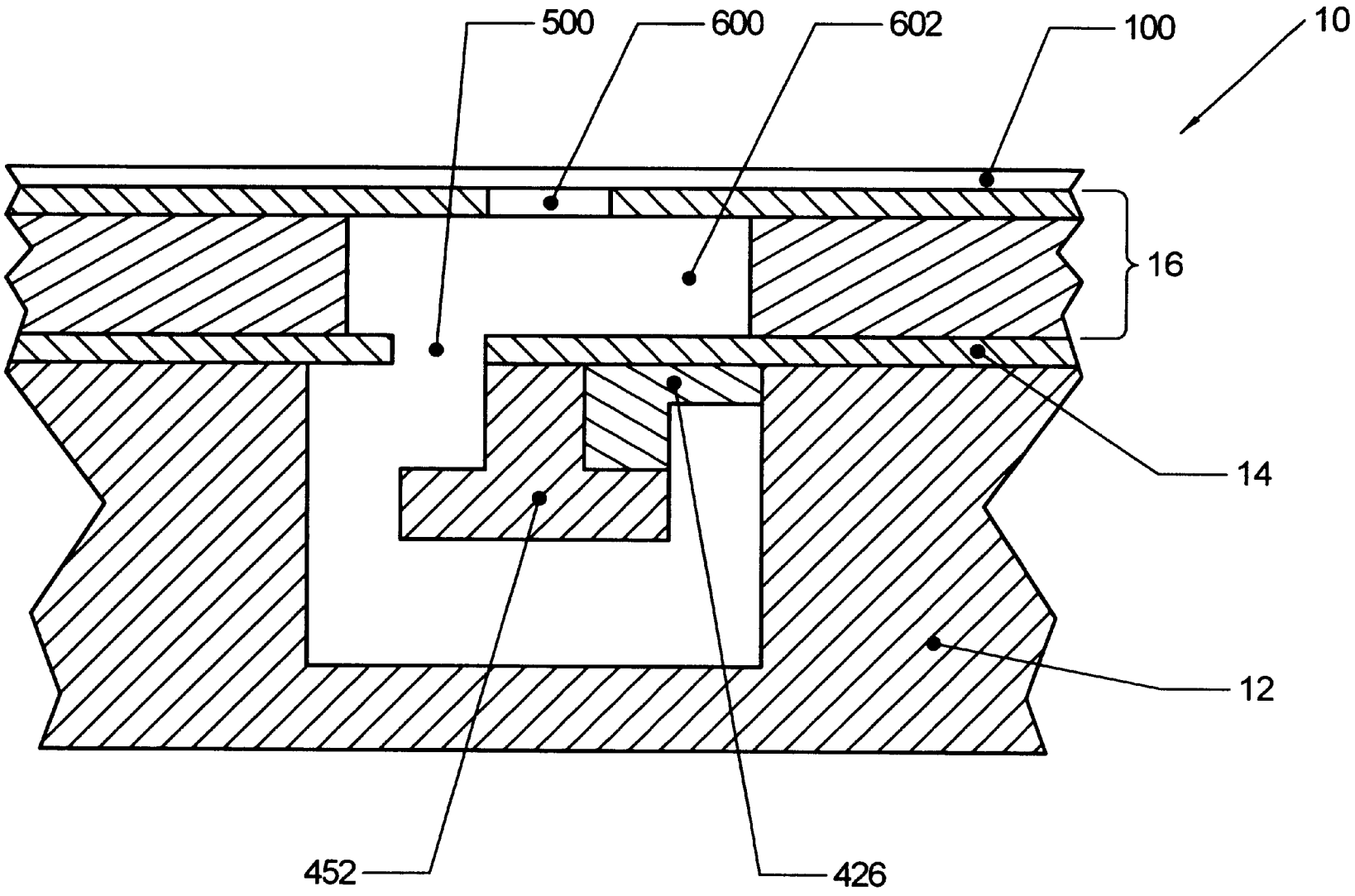
FIG. 10 is an illustration of a cross-section of a radiator of an exemplary embodiment of the present invention.

Referring now to FIG. 10, a cross section of a radiating element is depicted in the context of an exemplary antenna 10 of the present invention. The cross section view depicts the elevation relationship of the output slot 600, the cavity section 602, the input slot 500, and the tuning button 426, with respect to one another and with respect to the waveguide ridge 452.

An optional protective cover layer 100 can be applied to the front of the radiator plate 16. A thin dielectric material such as polyimide tape is used in this exemplary antenna.

As an alternative embodiment of the present invention, a slotted array antenna can be implemented as a single slotted array for supporting the communication of electromagnetic signals exhibiting a signal polarization state. In contrast to the interlaced array designs discussed above, this antenna design is characterized by a non-interlaced array of waveguide slot radiators, each comprising an input slot, a transitional cavity section, and an output slot. The transitional cavity section can rotate the polarization state of electromagnetic signals passing between the input slot and the output slot. This slotted array antenna is useful for both receiving and transmitting electromagnetic signals having a single polarization state.

The inventors have established the feasibility of using the improved waveguide slot radiator within a slotted array antenna designed by conducting a combination of analysis techniques. Finite element analysis, using Ansoft's "EMINENCE" and Hewlett Packard's "HIGH FREQUENCY STRUCTURE SIMULATOR" programs, provides scattering parameters for the waveguide slot radiator's connection into the ridge wall of the ridge waveguide channel. Finite element analysis or moment method codes provide the scattering parameters for the output slot's interface with the active array environment. Finite element analysis also provides scattering parameters for the series-series coupling from the feed distribution waveguide to the ridge waveguide channels. Connection of proper combinations of these scattering matrices provides a model of an entire antenna array. The inventive concepts described herein also have been proven by the fabrication and measurement of prototype subarrays and complete exemplary antennas, as shown in FIG. 1.

While the present invention is susceptible to various modifications and alternative forms, a preferred embodiment has been depicted by way of example in the drawings and will be further described in detail. It should be understood, however, that it is not intended to limit the scope of the present invention to the particular embodiments described. On the contrary, the intention is to cover all modifications, equivalents, and alternatives falling within the spirit and scope of the invention as defined by the appended claims.

I claim:

1. A waveguide slot radiator, comprising:

an input slot for communicating electromagnetic signals, the input slot having a top opening and a bottom opening;

an output slot for communicating the electromagnetic signals;

a cavity section comprising a cavity, a first opening positioned adjacent to the top opening of the input slot and a second opening positioned adjacent to the output slot, the cavity section connecting the first opening and the second opening and operative to rotate an electromagnetic field polarization of the electromagnetic signals from a first polarization state to a second polarization state; and a ridged waveguide, the ridged waveguide having a broad wall and an opposing ridge wall comprising a ridge;

wherein the bottom opening of the input slot is positioned adjacent to the ridge wall of the ridged waveguide.

2. The waveguide slot radiator of claim 1, wherein the ridge is a rectangular ridge.

3. The waveguide slot radiator of claim 1, wherein the ridge is a "T"-shaped ridge.

4. The waveguide slot radiator of claim 1, further comprising a tuning button, the tuning button positioned between the ridge and a first side wall of the ridged waveguide.

5. The waveguide slot radiator of claim 4, wherein the input slot is positioned substantially adjacent to a second side wall of the ridged waveguide, the second side wall being opposite the first side wall.

6. The waveguide slot radiator of claim 1, wherein the input slot is positioned a predetermined distance from a centerline of the ridge.

7. The waveguide slot radiator of claim 1, wherein the input slot is shorter than the output slot.

8. The waveguide slot radiator of claim 7, wherein the length of the input slot is less than ½ the length of the output slot.

9. The waveguide slot radiator of claim 1, wherein the output slot comprises a slot rotated relative to the position of the input slot, and the second opening of the cavity section is aligned with the rotated slot and operative to pass the electromagnetic signals between the rotated slot and the cavity section.

10. The waveguide slot radiator of claim 1, wherein the cavity section has a thickness of less than a wavelength.

11. The waveguide slot radiator of claim 1, wherein the cavity section comprises a uniform waveguide section having a thickness of less than a wavelength in the propagation direction, the first opening is aligned with the input slot, and the second opening is aligned with the output slot.

12. The waveguide slot radiator of claim 1, wherein the output slot communicates the electromagnetic signals at a radiation level and wherein the length of the input slot determines the radiation level.

13. A ridged waveguide-implemented antenna, comprising:

a plurality of parallel ridged waveguide structures, each ridged waveguide structure comprising a ridged waveguide defined by a broad wall and an opposing ridge wall, the broad wall and the ridge wall connected to a first side wall and a second side wall, each ridged waveguide corresponding to at least one waveguide slot radiator, each waveguide slot radiator comprising:

an input slot for communicating electromagnetic signals, the input slot positioned adjacent the ridge wall of each ridged waveguide;

an output slot for communicating the electromagnetic signals; and a cavity having a first opening positioned adjacent the input slot and a second opening positioned adjacent the output slot, the cavity being operative to pass the electromagnetic signals between the input slot and the output slot and being further operative to rotate an electromagnetic field polarization from a first polarization state to a second polarization state.

14. The ridged waveguide-implemented antenna of claim 13, wherein the ridge wall further comprises a ridge.

15. The ridged waveguide-implemented antenna of claim 14, wherein the ridge is a "T"-shaped ridge.

16. The ridged waveguide-implemented antenna of claim 14, wherein the ridge is a rectangular shaped ridge.

17. The ridged waveguide-implemented antenna of claim 14, wherein each radiator further comprises a tuning button, the tuning button positioned between the ridge and the first side wall of the ridged waveguide.

18. The ridged waveguide-implemented antenna of claim 17, wherein the input slot is positioned within the ridge wall substantially adjacent to the second side wall.

19. The ridged waveguide-implemented antenna of claim 14, wherein each ridged waveguide further comprises a tuning button, the tuning button positioned between the ridge and a selected one of either the first side wall or the second side wall; and wherein the tuning button of each radiator is positioned adjacent a different side wall than the tuning button of an adjacent radiator.

20. The ridged waveguide-implemented antenna of claim 19, wherein the input slot is located substantially adjacent to a side wall opposite the side wall to which the tuning button is adjacent.

21. The ridged waveguide-implemented antenna of claim 13, wherein a linear slot array comprises a plurality of waveguide slot radiators; and wherein all of the output slots of the ridge waveguide slot radiators in the linear slot array are rotated with respect to the input slots.

22. The ridged waveguide-implemented antenna of claim 21, wherein the output slots within the linear slot array are uniformly rotated with respect to the input slots within the linear slot array.

23. The ridged waveguide-implemented antenna of claim 13, wherein each cavity section is operative to provide an impedance match for efficient transmission of the electromagnetic signals between the input slot and the output slot, and wherein each cavity section is operative to rotate the polarization of the electromagnetic field from (to) the dominant mode polarization of the input slot to (from) the dominant mode polarization of the output slot.

24. The ridged waveguide-implemented antenna of claim 13 further comprising a waveguide-implemented single antenna structure comprising a first one of the antenna and second one of the antenna, the first antenna interlaced with the second antenna, the first antenna having its output slots rotated +45 degrees from its input slots, and the second antenna having its output slots rotated −45 degrees from its input slots, whereby the first and second antennas communicate electromagnetic signals having a pair of simultaneous orthogonal polarization states.

25. The antenna of claim 24, wherein the first and second antennas operate within the same band of frequencies.

26. The antenna of claim 24, wherein the first and second antennas operate in separate bands of frequencies.

27. A waveguide-implemented single antenna structure comprising two independent, interlaced antennas of claim 13, the first antenna having its output slots rotated with respect to its input slots, and the second antenna having its output slots rotated with respect to its input slots, whereby the two independent antennas communicate electromagnetic signals having a pair of simultaneous arbitrary linear polarization states.

28. The antenna of claim 27, wherein the first and second antennas operate within the same band of frequencies.

29. The antenna of claim 27, wherein the first and second antennas operate in separate bands of frequencies.

30. A ridged waveguide implemented antenna, comprising:

a single antenna structure comprising a first antenna interlaced with a second antenna;

the first antenna comprising a planar array of ridged waveguide slot radiators, each radiator comprising:

a first input slot for communicating electromagnetic signals, the first input slot having a top opening and a bottom opening, a first output slot for communicating the electromagnetic signals, a first cavity section comprising a first cavity, a first opening positioned adjacent to the top opening of the first input slot and a second opening positioned adjacent to the first output slot, the first cavity section connecting the first opening and the second opening and operative to rotate the electromagnetic field polarization of the electromagnetic signals from a first polarization state to a second polarization state, and a first ridged waveguide, the first ridged waveguide having a first broad wall and an opposing first ridge wall, the first ridge wall comprising a first ridge, wherein the bottom opening of the first input slot is positioned adjacent to the first ridge wall of the first ridged waveguide; and the second antenna comprising a second planar array of ridged waveguide slot radiators, each radiator comprising:

a second input slot for communicating the electromagnetic signals, the second input slot having a top opening and a bottom opening, a second output slot for communicating the electromagnetic signals, a second cavity section comprising a second cavity, a third opening positioned adjacent to the top opening of the second input slot and a fourth opening positioned adjacent to the second output slot, the second cavity section connecting the third opening and the fourth opening and operative to rotate the electromagnetic field polarization of the electromagnetic signals from a first polarization state to a second polarization state, and a second ridged waveguide, the second ridged waveguide having a second broad wall and an opposing second ridge wall, the second ridge wall comprising a second ridge, wherein the bottom opening of the second input slot is positioned adjacent to the second ridge wall of the second ridged waveguide.

31. The antenna of claim 30, wherein the first output slots of the first antenna are rotated from the first input slots of the first antenna, and the second output slots of the second antenna are rotated from the second input slots of the second antenna, whereby the first and second antennas communicate electromagnetic signals having a pair of simultaneous arbitrary linear polarization states.

32. The antenna of claim 31, wherein the first and second antennas operate within the same band of frequencies.

33. The antenna of claim 31, wherein the first and second antennas operate in separate bands of frequencies.

* * * * *